United States Patent [19]

Mourier

[11] Patent Number: 4,549,111

[45] Date of Patent: Oct. 22, 1985

[54] VHF RADIOELECTRIC WAVE GENERATOR

[75] Inventor: Georges Mourier, Paris, France

[73] Assignee: Thomson-CSF, Paris, France

[21] Appl. No.: 431,151

[22] Filed: Sep. 30, 1982

[30] Foreign Application Priority Data

Jan. 22, 1982 [FR] France ..... 82 01013

[51] Int. Cl.[4] ..... H01J 25/00

[52] U.S. Cl. ..... 315/4; 315/5; 372/2

[58] Field of Search ..... 315/3, 4, 5; 328/233; 372/2

[56] References Cited

U.S. PATENT DOCUMENTS

| | | | |
|---|---|---|---|
| 3,887,832 | 6/1975 | Drummond et al. | 315/4 |
| 4,070,595 | 1/1978 | Miller | 328/233 |
| 4,143,299 | 3/1979 | Sprangle et al. | 315/5 |
| 4,496,876 | 1/1985 | Young | 315/4 |

*Primary Examiner*—Saxfield Chatmon

*Attorney, Agent, or Firm*—Roland Plottel

[57] ABSTRACT

This invention concerns a microwave generator. For the purpose of maintaining synchronism between the microwave and electrons, at high energy levels (e.g. 0.5 to 1 MeV), the first part of the generator comprises a cylindrical wave guide, the section of which increases in radius along the direction of propagation of the electron beam. Such generators can be used to obtain millimeter and submillimeter waves, with high transverse evergy (e.g. approximately 10 MeV).

8 Claims, 2 Drawing Figures

VHF RADIOELECTRIC WAVE GENERATOR

Figure 1:
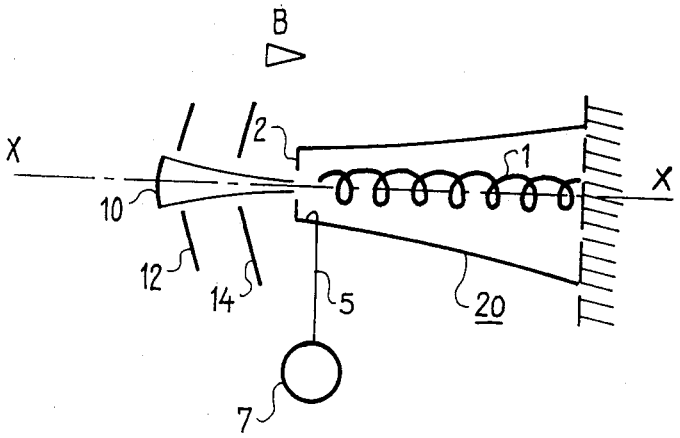

This patent concerns a microwave generator.

The U.S. Pat. No. 4,306,174, on behalf of THOMSON-CSF, concerns a microwave generator supplying millimeter and submillimeter waves.

Such a generator uses an electron beam propagated along its axis, and subjected to the combined effects of a magnetic field directed along the same axis, and of a high-frequency electric field directed transversely to the magnetic field.

The generator in question comprises two parts arranged in succession along its axis:

the first part, through which the electron beam enters, contains resonance spaces, which have a resonance frequency equal to the cyclotronic frequency $f_c$ of the electrons in the magnetic field, and which are fed at high frequency by a wave source, at the cyclotronic frequency $f_c$; the high-frequency electric field at frequency $f_c$ communicates energy to the electrons in this first part;

the second part, in resonance at a frequency close to a multiple $nf_c$ of the cyclotronic frequency, where energy at a frequency close to $nf_c$ is taken from a load.

Such a generator provides a maximum final transverse energy of approximately 100 KeV. It is not possible to obtain much higher energy levels, because of a relativistic effect.

As electron energy increases, its mass also increases:

$$m = m_0/\sqrt{1 - v^2/c^2},$$

and its rotational velocity drops:

$$\omega = (eB/m_0)\sqrt{1 - v^2/c^2}.$$

Synchronism between electron and wave is no longer maintained, and electron/wave interaction has to be stopped, before the electron begins to yield energy to the wave.

In the French patent application, field on Sept. 26, 1980, No. 80 20714, the same applicant has disclosed another type of generator, capable of supplying energies of 2 to 3 MeV. This generator uses an electron beam propagated along an axis, and subjected to the combined effects of a slowly increasing magnetic field, directed along the same axis, and of a high-frequency electric field, oriented, too, along this axis. This electric field is applied by a delay line, so that interaction occurs between the electric field and the electron beam. Growth of the magnetic field involves the presence of a radial component of said magnetic field, which converts the longitudinal energy caused by the electric field into transverse energy and thus allows the required aim to be achieved.

The problem with such a generator is the provision of a delay line, which is expensive to build and causes power losses.

The present invention concerns a generator, which can provide energies ranging, for example, from 0.5 to 1 Mev, without the need for a delay line.

This patent concerns a microwave generator having an electron beam transmitted along an axis subject to the action of a magnetic field directed along said axis and to an electromagnetic field of resonant cavities arranged along said axis. This generator comprises, coupled to said resonant cavities, a wave source, at a frequency equal to the cyclotron frequency $f_c$ of the electrons of the beam in the magnetic field, and a charge in which is picked up energy on a frequency close to a multiple $nf_c$ of said cyclotron frequency.

This patent concerns a generator, in which the resonant cavities are defined by a wave guide, the section of which varies along its axis, at least as regards that part of these cavities which is connected to the wave source.

The use of a variable-section wave guide helps to maintain synchronism between electrons and wave, even when electron energy rises sharply. This method of compensating for the relativistic effect observed in the U.S. patent cited will be explained below.

Figure 2:
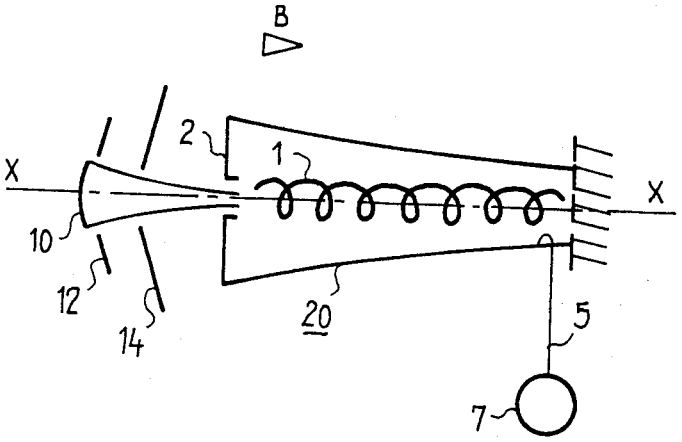
Figure 3:
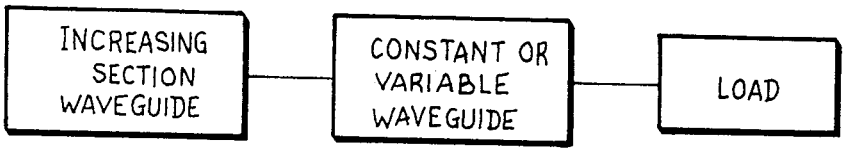
Figure 4:
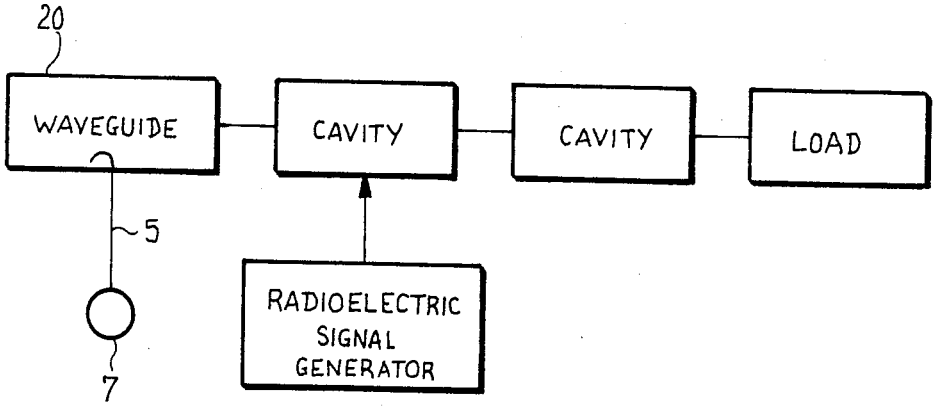

Other features, purposes and results of the invention will emerge from the following description which is given by way of example, but not of limitation, with reference to the accompanying FIGS. 1 and 2, showing two different embodiments of the generator according to the invention.

Similar references are used in these figures for similar components, but, for greater clarity, dimensions and proportions are not observed.

FIG. 1 shows a longitudinal section of one embodiment of the generator according to the present patent, using the same references as those visible in FIG. 2 of the U.S. patent cited.

The figure shows an electron gun comprising a circular cathode 10, a Pierce electrode 12, and an anode 14, which accelerates the beam 1, emitted by the cathode, and propagated along an axis XX.

A magnetic field B, produced by means not shown here, is directed longitudinally along axis XX.

The beam enters the first part of the generator, i.e. the accelerating portion, which comprises a cylindrical wave guide 20, the section 2 of which increases in the direction of propagation of the electron beam.

A wave source 7, i.e. an oscillator, is connected by an antenna 5 to the wave guide 20, on the beam input side, and energizes the guide at a frequency $f_c$, approximately equal to the cyclotronic frequency of the electrons placed in the magnetic field B. This source sets up an electric field in the guide at frequency $f_c$, transverse to the magnetic field.

FIG. 1 does not show the second part of the generator, i.e. the collector.

As disclosed in the U.S. patent cited, this second part by be formed of an extension of the wave guide of the first part. In the second part, the section of the waveguide may be constant or variable. As disclosed in the U.S. patent cited, a single cylindrical guide, the section of which is shaped as to form two diametrically opposite rectangular extensions, in order to obtain high-amplitude space harmonics at the frequency $nf_c$ may be used. This wave guide must also have an increasing section, at least in the first part of the generator. The second part of the generator may also be formed of a resonant cavity, separated from the wave guide in the first part, connected to a load, and resonant at a frequency close to $nf_c$.

As disclosed in the U.S. patent cited, there may also be three separated resonant cavities, through which the electron beam passes in turn. The first such cavity, formed of the wave guide 20, is coupled to the source 7, and is resonant at the cyclotronic frequency. The second is coupled to a radioelectric signal generator, which signal must be amplified at a frequency close to $nf_c$. Finally, the third cavity is coupled to the load, and is resonant at a frequency close to $nf_c$.

The second part of the generator may also be constituted by a Fabry Perot mirror or any other suitable structure, disclosed in the the literature related to gyrotrons.

FIG. 2 differs from FIG. 1 in that the wave source 7 is connected to the wave guide 20 on the beam output side, and the section of the guide decreases in the direction of propagation of the electron beam.

Naturally, as already stated in the U.S. patent cited, non-cylindrical guides can also be used for this generator: more specifically, guides having a rectangular section may be used.

The variable section of the wave guide helps to maintain synchronism between electrons and wave in the following way.

So that electrons will be constantly in phase with the wave, the cyclotronic frequency of electrons in the laboratory appliance (i.e. the electron gun) and the Doppler frequency, which is the wave frequency seen by electrons gun, simply need to be maintained along the whole of their path.

The cyclotronic frequency $f_c$ of electrons in the lab system is expressed as follows:

$$\omega_c = 2\pi f_c = \omega_{c0}\sqrt{1 - v^2/c^2} \quad (1)$$

with $\omega_{c0}=(e/m_0)B$, where e is the electron charge, $m_0$ is the mass of the electron at rest, B is the magnetic field set up along the axis XX', and v is the velocity of the electrons, with $v^2=v\perp^2+v//^2$, where v// is the electron velocity along the axis XX, v⊥ is the electron velocity along a direction perpendicular to XX, and c is the velocity of light.

The cyclotronic frequency $f_c$ is found to drop when electron energy, and therefore electron velocity, increase.

The Doppler frequency $f_D$ is expressed as follows:

$$\omega_D=2\pi f_D=\omega-kv_{//} \quad (2)$$

where ωis the pulsation corresponding to the frequency delivered by the wave source 7, and k, according to wave guide theory, is expressed:

$$k = \pm\sqrt{\omega^2/c^2 - k_c^2}$$

where $k_c$ is a quantity characterizing the mode being propagated and the cross section of the guide at the abscissa X in question. For example, in the case of a guide with a circular section of radius a, functioning on a mode $TE_{11}$, $k_ca=1.84$.

In the case of a rectangular guide, of length $d_1$ and width $d_2$:

$$(n^2\pi^2/d_1^2)=(m^2\pi^2/d_2^2)=k_c^2$$

where n and m are integers.

To ensure synchronism between electrons and wave, equality between equations 1 and 2 must be maintained, which means that it must be written, after k has been replaced by its expression in equation 2, as follows:

$$\omega_{c0}\sqrt{1 - v^2/c^2} = \omega - (\pm\sqrt{\omega^2/c^2 - k_c^2})v_{//} \quad (4)$$

To begin with, the magnetic field B will be assumed not to vary along the axis XX; $\omega_{c0}$ is therefore also constant.

ω is also a characteristic of the source 7, and through balancing of the various longitudinal accelerations, the value of $v_{//}$ varies little.

The increase in electron velocity v when energy increases is compensated by increasing k; this is done by adjusting the value of the coefficient $k_c^2$ by varying the cross section of the guide.

For example, in the case of a circular guide, the values of $v_{//}$ and v taken on by the electrons are calculated step-wise. The values of $k_c$ for which equation 4 applies are calculated, then, using equation 3, if the guide functions in mode $TE_{11}$, the different radii of the guide.

In FIG. 1, where the source 7 is connected to the guide on the electron input side, the coefficient k is positive. When energy and velocity v increase, the coefficient $k_c$ has to be reduced, and therefore the radius a of the guide increased, so that equation 4 will still apply. This is why the section of the circular guide in FIG. 1 increases, in the direction of propagation of the electron beam.

In FIG. 2, where the source 7 is connected to the guide on the electron beam output side, the coefficient k is negative, and the radius a of the guide has to be reduced, so that equation 4 will still apply. This is why the section of the circular guide in FIG. 2 decreases, in the direction of propagation of the electron beam.

It is possible to use a variable magnetic field B parallel to the axis of propagation. However, equation 4 cannot be maintained along the whole guide, by increasing $\omega_{c0}$, and therefore B, to compensate the reduction in the factor $$\sqrt{1 - v^2/c^2},$$

when energy increases. Increase in the magnetic field along the axis XX causes the appearance of radial component $B_r$, which slows down the electrons. This is why, if a magnetic field that increases along the axis of propagation is used, slowing caused by this field's radial component has to be compensated, by using a longitudinal electric field, and this requires a delay line. This is the method described in the french patent application filed on Sept. 26, 1980, already referred to. In conclusion, while it is possible with the generator proposed in this patent to use a magnetic field that varies along the axis of propagation a variable-section guide also has to be used, to ensure that equation 4 will apply throughout its length.

What is claimed is:

1. A microwave generator comprising (a) means including an electron gun (10, 12, 14) for generating an electron beam (1) along an axis (x—x);

(b) means for subjecting said electron beam to the action of amagnetic field (B) directed along said axis (x—x);

(c) waveguide means arranged along said axis for subjecting said electron beam to the action of an electromagnetic field;

(d) means coupled to said waveguide means for applying an electromagnetic wave (5, 7) at a frequency equal to the cylotron frequency fc of the electrons of the beam in the magnetic field;

(e) means for connecting to an output which receives energy at a frequency close to a multiple of said cyclotron frequency (n.fc);

(f) said waveguide means comprising a plurality of cavity resonators (20) which are coupled to said means for applying said electromagnetic wave, and which has an axis along said beam and which also has a cross section whose area varies along the axis of said wave guide, so that the cyclotron frequency of electrons in said electron beam and a Doppler shift frequency of the electron beam along the path of the electron beam are equal.

2. A generator as defined in claim 1, in which the means for applying said electromagnetic wave is connected to the wave guide on the electron beam input side, and the guide section increases in the direction of beam propagation.

3. A generator as defined in claim 1, in which the means for applying said electromagnetic wave is connected to the wave guide on the electron beam output side, and the guide section decreases in the direction of beam propagation.

4. A generator as defined in claim 1, in which the strength of the magnetic field varies along the axis of propagation.

5. A generator as defined in claim 1, in which the wave guide has circular or rectangular shape.

6. A generator as defined in claim 1, in which the resonant cavities are constituted by a single wave guide, the section of which varies along the axis of said guide.

7. A generator as defined in claim 6, in which the resonant cavities are constituted a single cylindrical guide, the section of which is shaped so as to provide two diametrically opposed rectangular extensions.

8. A generator as defined in claim 1, in which the resonant cavities comprise two separate resonance chambers, through which the electron beam passes successively, the first one of said chambers being constituted by the variable-section wave guide, connected to the wave source, and in resonance at the cyclotronic frequency, and the second chamber being connected to the load, and in resonance at a frequency close to said cyclotronic frequency.

* * * * *